United States Patent [19]

Jahn

[11] 4,292,182

[45] Sep. 29, 1981

[54] IMPARTING ANTI-SOILING PROPERTIES TO FIBERS

[75] Inventor: Alex K. Jahn, Williamsburg, Va.

[73] Assignee: Badische Corporation, Williamsburg, Va.

[21] Appl. No.: 196,424

[22] Filed: Oct. 14, 1980

Related U.S. Application Data

[63] Continuation-in-part of Ser. No. 955,847, Oct. 30, 1978, abandoned.

[51] Int. Cl.[3] ..... D06M 13/16; D06M 13/32

[52] U.S. Cl. ..... 252/8.6; 8/115.6; 8/116 P; 8/DIG. 21; 252/8.8; 252/8.9

[58] Field of Search ..... 252/8.6, 8.8, 8.9; 8/115.6, 116 P, DIG. 21

[56] References Cited

U.S. PATENT DOCUMENTS

| | | | |
|---|---|---|---|
| 2,286,794 | 6/1942 | Dickey et al. | 252/8.8 |
| 2,742,379 | 4/1956 | Schofield | 252/8.8 |
| 3,306,850 | 2/1967 | Olsen | 252/8.7 |
| 3,428,560 | 2/1969 | Olsen | 252/8.7 |
| 3,639,235 | 2/1972 | Karg | 252/8.9 |

*Primary Examiner*—John Kight, III

*Attorney, Agent, or Firm*—George F. Helfrich

[57] ABSTRACT

Anti-soiling properties are imparted to fibers by applying thereto an effective amount of the neutralized phosphate ester of an aliphatic alcohol having from 12 to 22 carbon atoms in the chain.

5 Claims, No Drawings

IMPARTING ANTI-SOILING PROPERTIES TO FIBERS

This application is a continuation-in-part of application Ser. No. 955,847, filed Oct. 30, 1978 and now abandoned.

BACKGROUND OF THE INVENTION

1. Field of the Invention

The invention relates generally to the conditioning of fibers, esp. textile fibers. It relates particularly to a process for rendering such fibers anti-soiling.

2. Prior Art Statement

Chemical compositions are universally applied to fiber surfaces to improve subsequent processing and handling of the fibers, and/or to impart a particular porperty thereto. Such compositions generally provide lubrication, prevent static build-up, and afford a slight cohesion between adjecent fibers. Exactly what is applied depends in large measure upon the nature—i.e., the chemical composition—of the fibers, the particular stage in the processing or handling thereof, and the end use in view. For example, compositions denominated "spin finishes" are applied to synthetic fiber tows, usually after stretching thereof, and frequently prior to subsequent processing thereof, including crimping, drying, cutting into staple lengths, carding, drawing, roving, and spinning. Such compositions generally provide lubrication, prevent static build-up, and afford a slight cohesion between adjacent fibers.

The application of chemical compositions to fibers is usually accomplished by contacting the fibers in the form of a tow, a yarn, or cut staple with a solution or an emulsion containing the desired chemical composition, employing standard padding, spraying (or overspraying) techniques.

For quite some time a need has existed in the industry for an effective means to impart anti-soiling properties to fibers, especially those which are used in the fabrication of floor coverings such as carpets and the like. As a result of considerable research, a number of expedients have been proposed and numerous finish compositions and methods have been developed—all of which are found wanting in one or more important aspects. That is to say, those which result in the imparting of low-, instead of anti-soiling properties to the treated fibers are unacceptable in today's market, which requires products of the highest quality. Moreover, fluorochemical compositions such as "Scotchguard" and "Zepel C", which do impart anti-soiling properties to fibers, are not only very expensive, but often interfere with proper processing of the fibers. As a consequence, the use of such materials is effectively limited to oversprays for finished products such as carpets.

Neutralized phosphate esters of aliphatic alcohols are not new, nor is the utilization of such materials as fiber finishes. In this regard, the following references are considered pertinent.

PRIOR ART STATEMENT

A. U.S. Pat. No. 2,742,379 discloses amine salts of alkyl esters of pentavalent phosphorus acids and their application to hydrophobic, non-cellulosic fibers in order to impart antistatic properties thereto. The alkyl chains have from 8 to 18 carbon atoms therein, and the esters are prepared by reacting 2 moles of alcohol with one mole of phosphoric pentoxide. Not disclosed or even remotely suggested is that anti-soiling properties may be imparted to such fibers if the neutralized phosphate ester has from 12 to 22 carbon atoms in the aliphatic chain—less than 12 carbon atoms being unsatisfactory for this purpose—and if the ester is prepared by reacting 3 moles of alcohol with one mole of phosphoric pentoxide.

B. U.S. Pat. No. 3,639,235 discloses the employment of a phosphoric acid ester of an ethylene oxide adduct of a $C_8$ to $C_{20}$ alkyl alcohol as an essential component of a fiber finish composition. In this art, phosphate esters of alkyl alcohols whether ethoxylated or not are considered as essentially equivalent, the choice of one or the other depending upon consideration of water dispersibility and emulsifying properties, which normally increase upon the introduction of a polyglycol chain. In this regard, U.S. Pat. No. 3,639,235 teaches the especial utility of the phosphoric acid esters of 2 to 8 mole ethylene oxide adducts of aliphatic alcohols. In sharp contradistinction thereto is the recognition in the present invention that even short polyglycol chains on the aliphatic alcohol destroy anti-soiling properties. (See Example 3, infra.)

SUMMARY OF THE INVENTION

The primary object of the present invention is to provide a process for rendering fibers, esp. textile fibers, anti-soiling. Related objects are to provide acrylic and polyamide fibers which are efficiently handled and readily processed, and which possess anti-soiling properties.

The primary object of the invention is achieved by the provision of a process which comprises applying to fibers, esp. textile fibers, an effective amount of neutralized phosphate ester of an aliphatic alcohol having from 12 to 22 carbon atoms in the chain, the ester having been prepared by reacting about 3 moles of alcohol with one mole of phosphoric pentoxide. Especially advantageous results are achieved when such aliphatic alcohol is a monohydric alcohol, and when this aliphatic monohydric alcohol is saturated. Highly efficacious results are obtained when a low-soiling spreading agent, such as a sodium dialkyl sulfosuccinate, is employed in admixture with the neutralized phosphate ester of the aliphatic alcohol.

One of the related objects of the invention is achieved by the provision of an acrylic fiber having anti-soiling properties, the fiber having incorporated thereon a finish comprising from about 0.1 to 1 percent by weight of the neutralized phosphate ester of a saturated aliphatic monohydric alcohol having from 12 to 22 carbon atoms in the chain, the ester having been prepared by reacting about 3 moles of alcohol with one mole of phosphoric pentoxide. Highly advantageous results are achieved when a low-soiling spreading agent—esp. a sodium dialkyl sulfosuccinate in an amount sufficient to provide from 1 to about 10 percent by weight of the incorporated finish—is employed in admixture with the neutralized phosphate ester of the saturated aliphatic monohydric alcohol.

Another related object of the invention is achieved by the provision of a polyamide fiber having anti-soiling properties, the fiber having incorporated thereon a finish comprising from about 0.2 to 2 percent by weight of the neutralized phosphate ester of a saturated aliphatic monohydric alcohol having from 12 to 22 carbon atoms in the chain, the ester having been prepared by reacting about 3 moles of alcohol with one mole of phosphoric pentoxide. Highly advantageous results are achieved when a low-soiling spreading agent—esp. a sodium dialkyl sulfosuccinate in an amount sufficient to provide from about 1 to about 10 percent by weight of the incorporated finish—is employed in admixture with the neutralized phosphate ester of the saturated aliphatic monohydric alcohol.

DETAILED DESCRIPTION OF THE PREFERRED EMBODIMENTS

For a more complete understanding of the present invention, reference should be made to the following detailed description of the preferred embodiments thereof.

The nuetralized phosphate ester of an aliphatic alcohol having from 12 to 22 carbon atoms in the chain, as employed in the present invention, is one of many available commercially. Such are commonly prepared by reacting the chosen aliphatic alcohol with $P_2O_5$, which results in the formation of a mixture of mono- and diester. The residual acidity of this reaction product is then neutralized, as with caustic or an amine. The chosen aliphatic alcohol may be saturated or unsaturated; and it may have a straight chain or a branched configuration. Although monohydric alcohols have been especially advantageously employed, polyhydric alcohols are not considered to be lacking in utility. In any event, it is essential that the aliphatic chain be no shorter than 12 carbon atoms and that there be no polyglycol branches (howsoever short) on the aliphatic alcohol chain, since either condition will vitiate the otherwise-imparted anti-soiling properties, as is evidenced by the specific Examples, infra. Moreover, the ester should be prepared by reacting about 3 moles of alcohol with one mole of phosphoric pentoxide.

The fibers to which anti-soiling properties are imparted are advantageously any of the textile fibers, especially man-made textile fibers such as acrylic and polyamide. Of particular importance are (a) acrylic fibers which have been spun from solutions of acrylonitrile polymers in inorganic solvents (see, e.g., U.S. Pat. No. 2,916,348 and U.S. Pat. No. 2,558,730) or organic solvents (see Knudsen, *Textile Research Journal,* 33, 13–20 (1963) ); and (b) polyamide fibers such as polycaprolactam which are melt spun employing standard techniques well known in the art (see Moncrieff, *Man Made Fibers,* John Wiley & Sons, Inc., 5th Ed., pp. 326–335 and 543–561 (1970) ).

The neutralized phosphate ester of the aliphatic alcohol is efficaciously applied to the fibers as a solution or dispersion, esp. as an aqueous dispersion, by any of a number of standard means such as spraying, padding, or the like, at virtually any stage in the processing of the tow, staple or spun fibers, advantageously after streathing thereof, or after the fabrication of the fibers or a yarn containing them into a finished construction, such as a floor covering (e.g., a carpet). To be effective in imparting anti-soiling properties to the fibers, the neutralized phosphate ester of the aliphatic alcohol is employed in an amount sufficient to provide from about 0.1 to about 2 percent by weight, based upon the weight of the fibers. When acrylic fibers are utilized, the effective amount of neutralized phosphate ester is from about 0.1 to about 1 percent by weight; when polyamide fibers such as polycaprolactam are utilized, the effective amount of neutralized phosphate ester is from about 0.2 to about 2 percent by weight.

In order to enhance the uniformity of application of the neutralized phosphate ester of the aliphatic alcohol, a low soiling spreading agent is beneficially employed in simple admixture therewith. This spreading agent, which is conveniently and advantageously provided in an amount sufficient to provide from about 1 to about 10 percent by weight of the incorporated fiber finish, is profitably a sodium dialkyl sulfosuccinate, esp. the dioctyl, di-isobutyl, diamyl, dihexyl, di-tridecyl, or di-octadecyl. Such spreading agents are disclosed in U.S. Pat No. 3,306,850 and U.S. Pat. No. 3,428,560. Other spreading agents which might be employed are sulfo succinamates, as well as sodium alkyl naphthalene sulfonate.

The present invention, especially its primary and related objects and multiple benefits, may be better understood by referring to the following examples, which are set forth for illustrative purposes only.

EXAMPLE 1

Acrylic carpet fiber was stock dyed to a yellow shade, oversprayed with 8% water, carded, spun into carpet yarn, and tufted into a carpet of level loop construction. No processing lubricant or antistat was used. Test samples of 2"×2" size were cut and the face sprayed with 7% water and dispersed therein 0.5% finish solids (percentages are based on the weight of the carpet sample). The samples were dried for 2 hours at 115° C. and let cool for 10 minutes at ambient temperature. All samples of one series were then shaken with an excess of soil in a glass jar for 10 minutes. The samples were then vacuum cleaned. The soil consisted of carpet sweepings from a vacuum cleaner (through 100-mesh screen) with 0.65% carbon black and 0.65% Nujol mineral oil added. The reflectance at 700 mμ was determined in a Large Sphere Color Eye. The percent reflectance R was converted into the Kubelka-Munk function K/S which equals $(1-R)^2/2R$ and is an approximate measure of colorant (or dirt in this case) concentration. By subtracting K/S obtained on an unsoiled carpet piece of the same kind from the K/S of a soiled sample, a comparative reading of the amount of dirt on each sample can be obtained. Experimental data on hydrogenated tallow alcohol ("HTA" containing 4% $C_{14}$, 30% $C_{16}$, 65% $C_{18}$, 1% $C_{20}$)phosphate salts are shown in Table I. DEA=diethanolamine: TEA=Triethanolamine.

All of the phosphate esters of the present invention which are formed in the instant and following examples were prepared using a molar ratio of alcohol to phosphoric pentoxide of 3/1.

TABLE I

| Series No | Overspray | K/S | ΔK/S Soil | ΔK/S Change From Control, % |
|---|---|---|---|---|
| 1 | None (unsoiled) | 0.0526 | | |
| | Water only (Control) | 0.538 | 0.485 | |
| | HTA Phosphate K-salt | 0.291 | 0.238 | −51 |
| | HTA Phosphate DEA salt | 0.502 | 0.449 | −7 |
| 2 | Water Only (Control) | 0.645 | 0.592 | |
| | HTA Phosphate K-salt | 0.441 | 0.388 | −35 |
| | HTA Phosphate Na-salt | 0.414 | 0.361 | −39 |
| | HTA Phosphate TEA salt | 0.481 | 0.428 | −28 |
| | HTA Phos. Morpholine salt | 0.440 | 0.387 | −35 |

It can be seen that all overspray finishes applied decrease the soiling, i.e. have antisoiling properties.

In Table II, a similar comparison is shown between phosphate esters of different alkyl chain length. The chains are unbranched except where indicated.

TABLE II

| Series No | Overspray | K/S | ΔK/S Soil | ΔK/S Change from Control, % |
|---|---|---|---|---|
| 3 | None (Unsoiled) | 0.0526 | | |
| | Water Only (Control) | 0.537 | 0.484 | |
| | $C_8$–$C_{10}$ Alcohol Phosphate K-salt | 1.535 | 1.482 | +206 |
| | Iso-$C_{10}$ Alcohol Phosphate K-salt | 1.570 | 1.517 | +213 |
| | Lauryl Alcohol Phosphate K-salt | 0.469 | 0.416 | −14 |

It can be seen that the phosphate esters made from $C_8$–$C_{10}$ alcohols lead to more soiling than the control. Contrary to this, lauryl ($C_{12}$) alcohol phosphate imparts antisoiling properties.

EXAMPLE 2

Acrylic carpet was made from stock dyed (yellow) fiber but the carpet construction in this series was cut pile. Otherwise, the experimental steps and tests were the same as described in Example 1. Table III shows data confirming that $C_8$–$C_{10}$ alcohol phosphates do not confer antisoilingl properties but $C_{12}$ (lauryl) alcohol phosphate does. Furthermore, $C_{14}$ and hydrogenated tallow ($C_{14}$–$C_{20}$) alcohol phosphates are shown to be antisoiling finishes.

TABLE III

| Series No | Overspray | K/S | ΔK/S Soil | ΔK/S Change From Control, % |
|---|---|---|---|---|
| 4 | None (Unsoiled) | 0.0691 | | |
| | Water Only (Control) | 0.858 | 0.789 | |
| | $C_8$–$C_{10}$ Alcoh. Phos. K-salt | 1.883 | 1.814 | +130 |
| | iso-$C_{10}$ Alcoh. Phos. K-salt | 1.920 | 1.851 | +135 |
| | Lauryl Alcoh. Phos. K-salt | 0.797 | 0.728 | −8 |
| 5 | Water Only (Control) | 0.631 | 0.562 | |
| | $C_{14}$ Alcoh. Phos. K-salt | 0.450 | 0.381 | −32 |
| | $C_{14}$–$C_{20}$ (HTA) Phos. K-salt | 0.475 | 0.406 | −28 |

EXAMPLE 3

The sample preparation was the same as in Examples 1 and 2. All samples are stock dyed (yellow). The carpet construction is noted in the table. This example is to demonstrate the deleterious effect of ethoxylation on the alkyl alcohol. In other words, phosphated polyglycol alkyl ethers do not show antisoiling properties.

TABLE IV

| Series No | Carpet Construct. | Overspray | K/S | ΔK/S Soil | ΔK/S Change From Control, % |
|---|---|---|---|---|---|
| 6 | Cut Pile | None (Unsoiled) | 0.0691 | | |
| | | Water Only (Control) | 0.631 | 0.562 | |
| | | $C_{12-14}$ Alcohol + 3EO, Phos. K- | 1.700 | 1.631 | +190 |
| | | $C_{16}$–$C_{18}$ Alcoh. + 6EO, Phos. K- | 1.811 | 1.742 | +210 |
| 7 | Cut Pile | Water Only (Control) | 0.660 | 0.591 | |
| | | Oleyl Alcoh. + 5EO, Phos. K- | 1.566 | 1.497 | +153 |
| | | Oleyl Alcoh. + 7EO, Phos. K- | 1.322 | 1.253 | +112 |
| | | Oleyl Alcoh. + 19EO, Phos. K- | 1.621 | 1.552 | +163 |
| 8 | Level Loop | None (Unsoiled) | 0.526 | | |
| | | Water Only (Control) | 0.355 | 0.302 | |
| | | $C_{16}$–$C_{18}$ Alcoh. + 10EO, Phos. K- | 0.961 | 0.908 | +200 |
| | | $C_{16}$–$C_{18}$ Alcoh. + 15EO, Phos. K- | 0.970 | 0.917 | +204 |
| | | $C_{16}$–$C_{18}$ Alcoh. + 20EO, Phos. K- | 0.878 | 0.825 | +173 |

EXAMPLE 4

Acrylic carpet fiber was made with 0.2% hydrogenated tallow alcohol phosphate, K-salt as the finish applied to the tow, before crimping and cutting into staple. This fiber was oversprayed with 8% water, carded, spun into yarn, and tufted into a level loop carpet of natural color (Sample 1). Another part of the staple was oversprayed with an additional 0.4% of the same finish besides 8% water and made into a level loop carpet (Sample2). Both carpets were tested in the Tetrapod Accelerated Wear Tester in contact with carpet sweepings from a vacuum cleaner. Samples were removed after 10,000; 15,000; and 30,000 drum rotations (cycles).

TABLE V

| Sample No | Unsoiled % Reflect. | Unsoiled K/S | 10,000 K/S | 15,000 K/S | 30,000 Cycles K/S | K/S Increase Over unsoiled, % |
|---|---|---|---|---|---|---|
| 1 | 73.55 | 0.0476 | 0.155 | 0.311 | 0.335 | 604 |
| 2 | 72.24 | 0.0533 | 0.152 | 0.234 | 0.245 | 360 |

It can be seen that an increase in the finish by a factor of 3 results in a decrease in soiling by a factor of 1.7.

EXAMPLE 5

Nylon 6 carpet staple was made into a level-loop carpet. After piece dyeing (yellow) and drying, 1% hydrogenated tallow alcohol (HTA) phosphate, K-salt, dispersed in 3% water, (percentages are based on carpet weight) were brushed onto the face of a 2"×2" piece of this carpet. After drying at 80° C. for 2 hours, followed by 15 minutes at 115° C., and cooling for 10 minutes, this sample and a control (water brushed on and treated in a like manner) were shaken with soil (composition given in Ex. 1) in a glass jar for 10 minutes and then vacuum cleaned. The results of reflectance measurements are given in Table VI.

TABLE VI

| Finish | K/S | ΔK/S Soil | ΔK/S Change from Control % |
|---|---|---|---|
| None (Unsoiled) | 0.0363 | | |
| Water Only, Control | 0.155 | 0.119 | |
| HTA Phosphate K-salt | 0.139 | 0.103 | −13 |

EXAMPLE 6

Two commercial level-loop acrylic "heather" type carpets containing 70% fiber of natural color were floor tested. The natural fiber in carpet No. 1 was made with 0.25% hydrogenated tallow alcohol phosphate, K-salt, as the finish applied to the tow on the fiber production line before crimping and cutting into staple. The natural fiber in carpet No. 2 was made in the same way but with 0.25% n-octyl/n-decyl alcohol phosphate, K-salt, as the finish. Everything in fiber processing and carpet tufting was the same for both carpets. The two carpets were laid on the floor side-by-side in a heavy traffic area. After 22,000 steps and vacuum cleaning, the difference in soiling could clearly be seen. Carpet No. 2 had picked up significantly more soil than carpet No. 1. Table VII shows reflectance measurements similar to those reported in the previous examples.

TABLE VII

| Carpet No | Unsoiled % Reflect. | Unsoiled K/S | Soiled on Floor % Reflect. | Soiled on Floor K/S | ΔK/S Soil | ΔK/S Increase Over unsoiled, % |
|---|---|---|---|---|---|---|
| 1 | 61.59 | 0.1198 | 54.46 | 0.1904 | 0.0706 | 59 |
| 2 | 61.80 | 0.1181 | 50.75 | 0.2390 | 0.1209 | 102 |

It can be seen that the carpet containing natural fiber with $C_8$–$C_{10}$ alcohol phosphate picked up 73% more dirt than the one containing the same proporation of natural fiber with hydrogenated tallow alcohol phosphate.

EXAMPLE 7

Acrylic carpet fiber was made with 0.25% of a finish consisting of 95% hydrogenated tallow alcohol phosphate, K-salt, and 5% sodium dioctyl sulfosuccinate. The finish was applied to the tow, before crimping and cutting into staple. This fiber was oversprayed with 8% water, carded, spun into yarn, and tufted into a level-loop carpet of natural color (Sample 1). In a paralleled experiment, the finish consisted of hydrogenated tallow alcohol phosphate only (Sample 2.). Both carpets were tested in the Tetrapod Accelerated Wear Tester in contact with carpet sweepings from a vacuum cleaner. Samples were removed after 10,000 and 20,000 drum rotations (cycles), vacuum cleaned, and reflectance measurements made for judgement of soil pickup. The addition of the spreading agent did not interefore with the low-soiling characteristics of the phosphate ester finish.

EXAMPLE 8

In accordance with the procedure of Example 1 of the present application, acrylic carpet fiber was stock dyed to a yellow shade, oversprayed with 8% water, carded, spun into carpet yarn, and tufted into a carpet of level loop construction. No processing lubricant or antistat was used. Test samples of 2"×2" size were cut and the face sprayed with 7% water and dispersed therein 0.5% finish solids (percentages are based on the weight of the carpet sample). The samples were dried for 2 hours at 115° and let cool for 10 minutes at ambient temperature. All samples of one series were then shaken with an excess of soil in a glass jar for 10 minutes. The samples were then vacuum cleaned. The soil consisted of carpet sweepings from a vacuum cleaner (through 100-mesh screen) with 0.65% carbon black and 0.65% Nujol mineral oil added. The reflectance at 700 mu was determined in a Large Sphere Color Eye. The percent reflectance R was converted into the Kubelka-Munk function K/S which equals $(1-R)^2/2R$ and is an approximate measure of clorant (or dirt in this case) concentration. By subtracting K/S obtained on an unsoiled carpet piece of the same kind from the K/S of a soiled sample, a comparative reading of the amount of dirt on each sample can be obtained. Experimental data on hydrogenated tallow alcohol ("HTA" containing 4% $C_{14}$, 30% $C_{16}$, 65% $C_{18}$, 1% $C_{20}$) phosphate salts are shown in Table VIII below. Due to the presence of an additional filter in the Large Sphere Color Eye, the K/S values shown in Table VIII below are higher than those shown in Table I of Example I of the application, but there is strict comparability between the values in each group.

TABLE VIII

| Series No. | Overspray | % Reflectance | K/S | ΔK/S Soil |
|---|---|---|---|---|
| 9 | None (unsoiled) | 35.28 | 0.594 | — |
| | HTA Phosphate, K-salt, Alcohol $P_2O_5$3/1 | 24.62 | 1.154 | 0.560 |
| | HTA Phosphate, K-salt, Alcohol/$P_2O_5$2/1 | 20.69 | 1.520 | 0.926 |
| 10 | None (unsoiled) | 35.28 | 0.594 | — |
| | HTA Phosphate, K-salt, Alcohol/$P_2O_5$3/1 | 24.16 | 1.190 | 0.596 |
| | HTA Phosphate, K-salt, Alcohol/$P_2O_5$2/1 | 20.45 | 1.547 | 0.935 |
| | HTA Phosphate, K-salt, Alcohol/$P_2O_5$2/1 Larger-scale product | 20.41 | 1.552 | 0.958 |

From Table VIII it can be seen that the carpet samples with the HTA phosphate made at a molar ratio of 2/1 are unacceptable in that they soil 60–65% more than those with HTA phosphate made at a molar ratio of 3/1.

I claim:

1. A process for imparting anti-soiling properties to fibers, which process comprises applying to the fibers an effective amount of the neutralized phosphate ester of an aliphatic alcohol having from 12 to 22 carbon atoms in the chain, the ester having been prepared by reacting about 3 moles of alochol with one mole of phosphoric pentoxide.

2. The process of claim 1, wherein the aliphatic alcohol is a monohydride alcohol.

3. The process of claim 2, wherein the aliphatic monohydric alcohol is saturated.

4. Acrylic fiber having anti-soiling properties, the fiber having incorporated thereon a finish comprising from about 0.1 to 1 percent by weight of the neutralized phosphate ester of a saturated aliphatic monohydric alcohol having from 12 to 22 carbon atoms in the chain, the ester having been prepared by reacting about 3 moles of alcohol with one mole of phosphoric pentoxide.

5. Polyamide fiber having anti-soiling properties, the fiber having incorporated thereon a finish comprising from about 0.2 to 2 percent by weight of the neutralized phosphate ester of a saturated aliphatic monohydric alcohol having from 12 to 22 carbon atoms in the chain, the ester having been prepared by reacting about 3 moles of alcohol with one mole of phosphoric pentoxide.

* * * * *

UNITED STATES PATENT AND TRADEMARK OFFICE

CERTIFICATE OF CORRECTION

PATENT NO. : 4,292,182

DATED : September 29, 1981

INVENTOR(S) : Alex K. Jahn

It is certified that error appears in the above-identified patent and that said Letters Patent are hereby corrected as shown below:

Column 5, TABLE IV, last line of Series No. 7:

Change "19 EO" to --9 EO--.

Column 5, TABLE IV, first line of Series No. 8:

Change "0.526" to --0.0526--.

Column 8, line 28, last column:

Change "0.935" to --0.953--.

Column 8, line 46:

Change "monohydride" to --monohydric--.

Signed and Sealed this

*Twenty-third* Day of *March 198*

[SEAL]

*Attest:*

GERALD J. MOSSINGHOFF

*Attesting Officer*

*Commissioner of Patents and Trademarks*